US006454644B1

(12) United States Patent
Miyazaki et al.

(10) Patent No.: US 6,454,644 B1
(45) Date of Patent: Sep. 24, 2002

(54) POLISHER AND METHOD FOR MANUFACTURING SAME AND POLISHING TOOL

(75) Inventors: Hisamitsu Miyazaki, Iruma (JP); Hirokuni Hiyama, Tokyo (JP); Yutaka Wada, Chigasaki (JP)

(73) Assignees: Ebara Corporation, Tokyo (JP); Mitsui Grinding Wheel Co., Ltd., Saitama-Ken (JP)

( * ) Notice: Subject to any disclaimer, the term of this patent is extended or adjusted under 35 U.S.C. 154(b) by 13 days.

(21) Appl. No.: 09/629,440

(22) Filed: Jul. 31, 2000

(51) Int. Cl.[7] ..... B24D 11/00
(52) U.S. Cl. ..... 451/526; 451/539
(58) Field of Search ..... 451/526, 528, 451/539; 51/298, 295, 293

(56) References Cited

U.S. PATENT DOCUMENTS

| | | | | | |
|---|---|---|---|---|---|
| 3,716,950 | A | * | 2/1973 | McClure | 51/206 |
| 4,150,514 | A | * | 4/1979 | Douglass | 51/298 |
| 4,336,178 | A | * | 6/1982 | Heidingher et al. | 523/206 |
| 4,555,551 | A | * | 11/1985 | Makhlouf et al. | 525/455 |
| 4,924,566 | A | * | 5/1990 | Shiraishi et al. | 28/143 |
| 4,943,472 | A | * | 7/1990 | Dyksterhouse et al. | 428/240 |
| 5,520,711 | A | * | 5/1996 | Helmin | 51/295 |
| 5,633,068 | A | * | 5/1997 | Ryoke et al. | 428/143 |
| 5,924,917 | A | * | 7/1999 | Benedict et al. | 451/526 |
| 6,004,198 | A | * | 12/1999 | Sumiyoshi | 451/535 |
| 6,159,087 | A | * | 12/2000 | Birang et al. | 451/526 |
| 6,206,759 | B1 | * | 3/2001 | Agarwal et al. | 451/41 |
| 6,217,426 | B1 | * | 4/2001 | Tolles et al. | 451/285 |
| 6,328,644 | B1 | * | 12/2001 | Kuramochi et al. | 451/526 |

FOREIGN PATENT DOCUMENTS

| | | | | |
|---|---|---|---|---|
| JP | 362280013 A | * | 12/1987 | 264/257 |
| JP | 410329031 A | * | 12/1998 | B24D/3/28 |

* cited by examiner

*Primary Examiner*—Timothy V. Eley
*Assistant Examiner*—David B Thomas
(74) *Attorney, Agent, or Firm*—Wenderoth, Lind & Ponack, L.L.P.

(57) ABSTRACT

A polishing tool uses a fixed abrasive polisher which can perform polishing of an object with good surface accuracy for a long period of time. A mixture of abrasive grains, having an average particle diameter of 0.01 to 2.0 $\mu$m, and comprising at least one of cerium oxide, manganese oxide, titanium oxide, zirconia, silica, and iron oxide, and polyimide resin particles or phenolic resin particles having an average particle diameter of 0.1 to 20 $\mu$m is heated at a temperature of 120 to 250° C. under a pressure of 9,800 to 49,000 kPa (100 to 500 kg/cm$^2$) to mold the mixture into a desired shape. This can provide a polisher 4 having abrasive grains dispersed in a thermosetting resin, and having abrasive grains of 20 to 60% by volume, a binder of 30 to 50% by volume, pores of not more than 40% by volume, and a Rockwell hardness of not less than 30 in terms of the H scale. This polisher is attached to a surface plate by an epoxy adhesive to produce a polishing tool.

17 Claims, 10 Drawing Sheets

POLISHER AND METHOD FOR MANUFACTURING SAME AND POLISHING TOOL

BACKGROUND OF THE INVENTION

1. Field of the Invention

The present invention relates to a technical field of polishing, and more particularly to a fixed abrasive polisher which can polish an object for a long period of time with high surface accuracy and without causing any damage during working, a process for producing the polisher, and a polishing tool using the polisher.

2. Description of the Related Art

Conventionally, in producing semiconductor devices such as DRAMs, other memories and microprocessors, predetermined circuit elements are formed on a surface of a semiconductor substrate, for example, a silicon substrate (a wafer), and insulating layers and wiring layers are formed on the surface of the silicon wafer to thus form a predetermined electronic circuit together with the above circuit elements.

In the production of such semiconductor devices, the steps of forming an insulating layer and a wiring layer, patterning the insulating layer and the wiring layer into a predetermined shape, further forming thereon an insulating layer and a wiring layer, and patterning the insulating layer and the wiring layer into a predetermined shape are repeated. Therefore, when forming the upper layer, the underlying surface begins to have irregularities formed thereon of a considerable level, and, in this state, an attempt to perform layer formation and patterning leads to the difficulty of forming a pattern having good uniformity in thickness and good shape.

In recent years, as the number of layers in multilayer wiring increases gradually, in order to solve the above problem, polishing is carried out to planarize the underlying layer, particularly a silicon oxide insulating layer, before the formation of the upper layer.

This polishing has hitherto been carried out by the so-called "free abrasive polishing" in which a foamed polyurethane pad used for polishing glass and serving as a polisher is attached to the surface of a surface plate to form a polishing tool. Such a polishing tool is relatively moved while pressing the tool against the surface of an object to be polished (a silicon wafer with a layer formed on the surface thereof) at a certain pressure and, at the same time, while supplying a polishing liquid containing abrasive grains, for example, cerium oxide particles, thereby polishing the object.

According to this free abrasive polishing, however, it has been difficult to finish the surface of the silicon wafer having fine irregularities to a good flatness. This is because the foam polyurethane pad as the polisher constituting the polishing tool is relatively soft, and hence, it is difficult to obtain a desired flatness (surface accuracy).

Therefore, an effort has been made to improve the hardness of a polisher such as a foam polyurethane pad. Nevertheless, the free abrasive polishing cannot provide a sufficient surface accuracy.

On the other hand, Japanese laid-open patent publication No. 9-232257 discloses a polishing method in which polishing is performed with a polishing grindstone (a polisher) comprising abrasive grains such as cerium oxide bound in an organic resin material such as a phenolic resin. In this case, the polishing of an object is performed while supplying an abrasive slurry such as colloidal silica to a polishing tool comprising the above polishing grindstone attached to a surface plate.

The polishing method disclosed in Japanese laid-open patent publication No. 9-232257, however, uses a fixed-abrasive grindstone in combination with an abrasive slurry containing free abrasive grains. This polishing method produces a large quantity of waste liquid containing free abrasive grains, and thus, necessitates troublesome waste liquid treatment. In addition, the polishing method is liable to produce dust of abrasive grains contained in the abrasive slurry and mist containing the abrasive grains. Therefore, disadvantageously, measures should be taken to prevent the dust and mist from reaching the silicon wafer. Further, the combined use of the free abrasive grains and the fixed abrasive grains causes rapid wastage of the polishing grindstone, and thus, makes it difficult to maintain the surface accuracy of the polishing grindstone for a long period of time. Therefore, it is difficult to maintain a high surface accuracy of the polished objects for a long period of time. Disadvantageously, if it is contemplated that the high surface accuracy of the polished objects should be maintained for a long period of time, dressing should be frequently carried out to ensure the surface accuracy of the polishing grindstone.

SUMMARY OF THE INVENTION

It is therefore an object of the present invention to provide a fixed abrasive polisher which is free from the above problems involved in the use of free abrasive grains and can perform polishing of objects with high surface accuracy for a long period of time, and to provide a polishing tool using such polisher.

In order to achieve the above object, according to the present invention, there is provided a polisher comprising abrasive grains dispersed in a thermosetting resin, the polisher having abrasive grains of 20 to 60% by volume, a binder of 30 to 50% by volume, and pores of not more than 40% by volume.

According to one aspect of the present invention, the abrasive grains comprise at least one of cerium oxide, manganese oxide, titanium oxide, zirconia, silica, and iron oxide.

According to one aspect of the present invention, the abrasive grains have an average particle diameter of 0.01 to 2.0 $\mu$m. According to one aspect of the present invention, the thermosetting resin comprises a polyimide resin or a phenolic resin. According to one aspect of the present invention, the Rockwell hardness is not less than 30 in terms of the H scale.

In order to achieve the above object, according to the present invention, there is provided a process for producing a polisher, characterized in that a mixture of abrasive grains and thermosetting resin particles is heated under pressure to mold the mixture into a desired shape.

According to one aspect of the present invention, the pressure is in the range of 9,800 to 49,000 kPa (100 to 500 kg/cm$^2$). According to one aspect of the present invention, the heating temperature is in the range of 120 to 250° C. According to one aspect of the present invention, abrasive grains comprising at least one of cerium oxide, manganese oxide, titanium oxide, zirconia, silica, and iron oxide are used. According to one aspect of the present invention, the abrasive grains have an average particle diameter of 0.01 to 2.0 $\mu$m. According to one aspect of the present invention, thermosetting resin particles comprising polyimide resin particles or phenolic resin particles are used. According to one aspect of the present invention, the thermosetting resin particles have an average particle diameter of 0.1 to 20 $\mu$m.

In order to achieve the above object, according to a further aspect of the present invention, there is provided a polishing tool comprising the above polisher mounted on a polisher holding member.

According to one aspect of the present invention, the polisher is mounted on the polisher holding member by an adhesive. According to one aspect of the present invention, the polisher has grooves on its surface. According to one aspect of the present invention, the polisher is mounted on the polisher holding member by mounting a plurality of polisher segments. According to one aspect of the present invention, the polisher is mounted on the polisher holding member by mounting a plurality of polisher pellets.

DETAILED DESCRIPTION OF THE PREFERRED EMBODIMENTS

Embodiments of the present invention will be described below with reference to the accompanying drawings.

Figure 1:
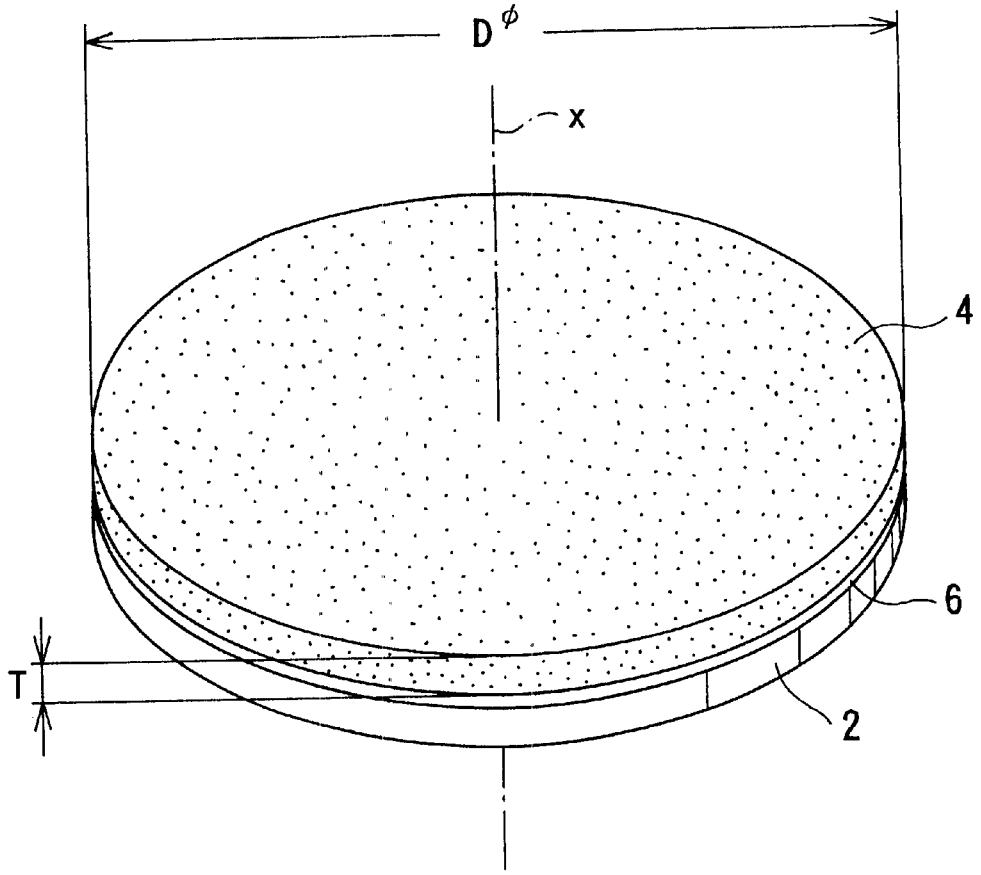
FIG. 1 is a schematic perspective view showing a first embodiment of a polishing tool using the polisher according to the present invention.

FIG. 1 is a schematic perspective view showing a first embodiment of a polishing tool using the polisher according to the present invention. In FIG. 1, a disk-shaped polisher 4 is attached to the top surface of a circular surface plate 2 serving as a polisher holding member by an adhesive 6.

The circular surface plate 2 is composed of a material which is not chemically eroded by a polishing liquid during a polishing process, for example, stainless steel, titanium, various ceramics, aluminum which has been rendered corrosion resistant by surface treatment such as anodization or baking coating, or a corrosion resistant, alloy such as Hastelloy or Inconel.

The polisher 4 comprises abrasive grains dispersed in a thermosetting resin and has abrasive grains of 20 to 60% by volume, a binder of 30 to 50% by volume, and pores of not more than 40% by volume. The polisher 4 has a diameter Dϕ of, for example, 200 to 1,000 mmϕ, and a thickness T of, for example, 5 to 20 mm. This polisher 4 may be produced by heating a mixture of abrasive grains and thermosetting resin particles under pressure to mold the mixture into a desired shape.

Abrasive grains usable herein include those which have hitherto been commonly used as abrasive grains, such as cerium oxide particles, manganese oxide particles, titanium oxide particles, zirconia particles, silica particles, and iron oxide particles. Commercially available abrasive grains of this type mostly do not have a purity of 100%. For example, abrasive grains of cerium oxide in many cases contain rare earth elements such as lanthanum and neodymium. The purity is not always required to be 100%. The purity of the abrasive grains, however, is preferably not less than 50%. Further, the abrasive grains may be in the form of a mixture of a plurality of types of particles, for example, selected from the above-described cerium oxide particles, manganese oxide particles, titanium oxide particles, zirconia particles, silica particles, and iron oxide particles. The abrasive grains used may have an average particle diameter of, for example, 0.01 to 2.0 $\mu$m.

The thermosetting resin particles usable herein include polyimide resin particles, including partially modified polyimide resin particles, or phenolic resin particles. The thermosetting resin particles usable herein have an average particle diameter of, for example, 0.1 to 20 $\mu$m. The thermosetting resin preferably has a relatively high temperature for curing, and polyimide resin is particularly preferred. It is desirable that for these thermosetting resins, the content of elements and constituents, which adversely affect the objects to be polished, such as silicon wafers, during a polishing process, is the allowable limit or less.

In the production of the polisher 4, the above-described abrasive grains and thermosetting resin particles are blended together in a desired ratio, followed by dry mixing for a proper period of time, for example, one hour. Thereafter, the mixture is placed in a mold that can form a cavity having a shape corresponding to the shape of the polisher 4. Pressure is applied to the mixture while heating the mixture to bind thermosetting resin powder particles together in such a state that the abrasive grains are dispersed in the thermosetting resin powder particles. In this case, proper selection of temperature and pressure conditions can realize control of the volume ratio of the remaining pores. According to the present invention, the abrasive grains and the thermosetting resin particles are blended together by the dry mixing of powder particles. This permits the abrasive grains to be sufficiently uniformly dispersed in resin particles, and this dispersed state can be maintained even within the mold. Therefore, in the polisher according to the present invention, the dispersed state of the abrasive grains is better than that of the abrasive grains in the polisher produced by mixing abrasive grains with a liquid resin and then molding the mixture.

The heating temperature is high enough to bind the thermosetting resin particles together, and may be, for example, 120 to 250° C., and particularly 150 to 250° C. The heating temperature may be, for example, 230° C. for polyimide resins, and, for example, 160° C. for phenolic resins. The pressure may be, for example, 9,800 to 49,000 kPa (100 to 500 kg/cm$^2$).

By the above process, a polisher 4 having a Rockwell hardness in terms of the H scale (RH) of not less than 30 can be produced. This Rockwell hardness value corresponds substantially to a Young's modulus of 500 kg/mm$^2$. The above hardness of the polisher is sufficiently high as compared with the hardness of the fixed abrasive polisher disclosed in Japanese laid-open patent publication No. 9-232257, noted above.

In FIG. 1, X represents the center of rotation of the surface plate 2. The polishing tool is mounted on a rotating means (not shown), and is rotated about the center X of rotation. If desired, the polisher 4 may be rotated about the center X of rotation, in such a state that the polisher 4 is mounted on the surface plate 2, to dress the surface (a surface having polishing action) and, in addition, the peripheral surface of the polisher 4 to a predetermined surface accuracy by grinding or cutting.

Figure 2:
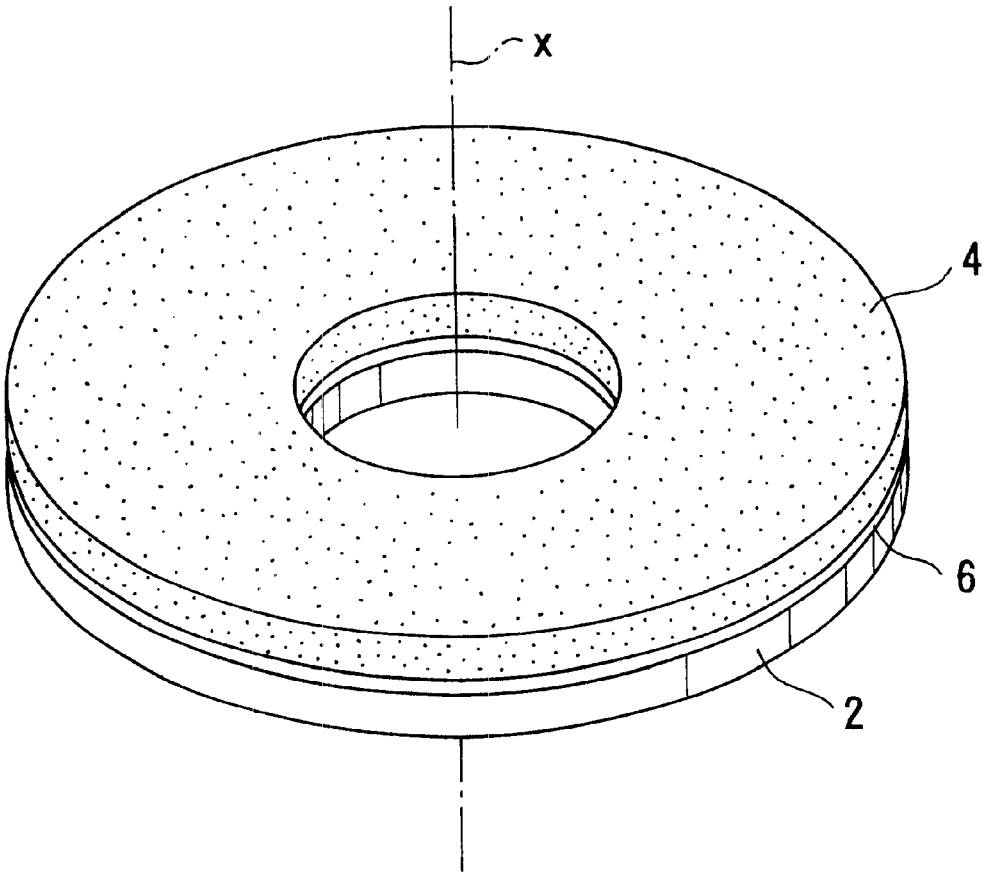
FIG. 2 is a schematic perspective view showing a second embodiment of a polishing tool using the polisher according to the present invention.

FIG. 2 is a schematic perspective view showing a second embodiment of a polishing tool using the polisher according to the present invention. In FIG. 2, components having the same function as those in FIG. 1 are denoted by the same reference numerals as used in FIG. 1.

This embodiment is different from the first embodiment only in that the surface plate 2 and the polisher 4 both have an opening in their center and are annular.

Figure 3:
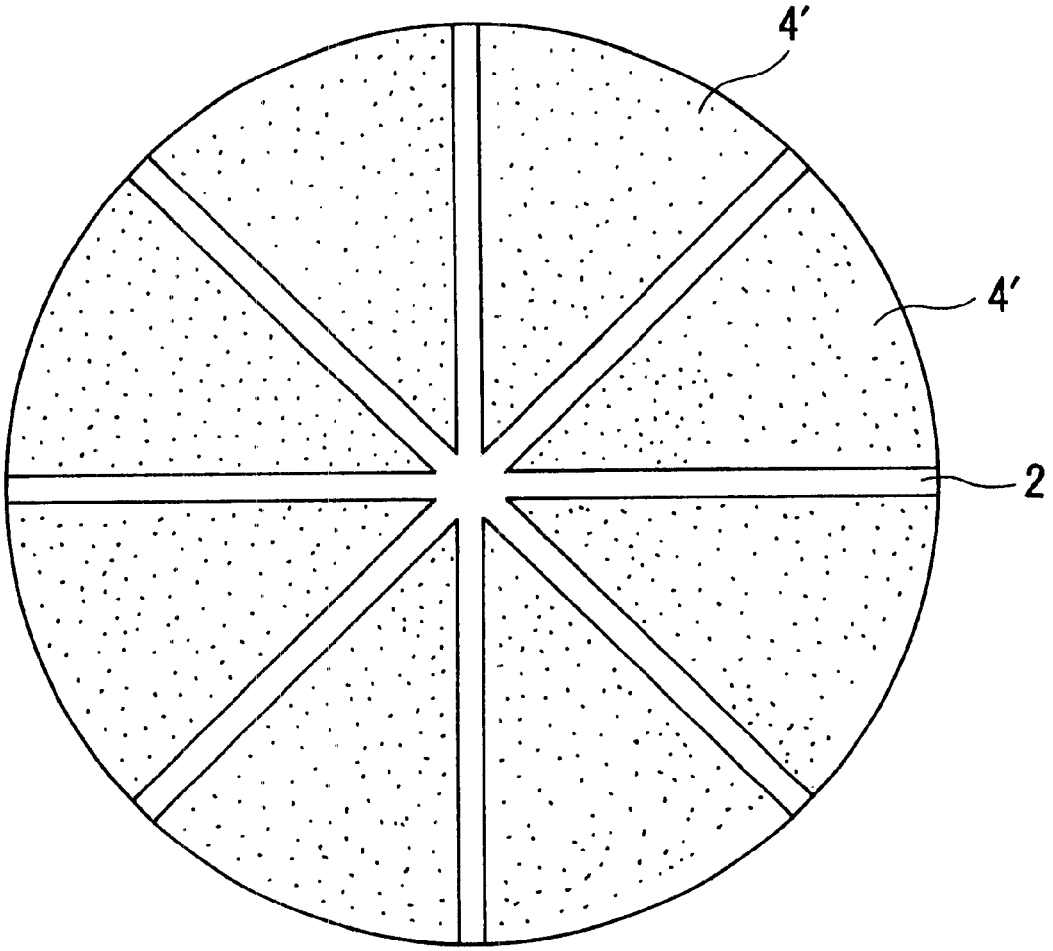
FIG. 3 is a schematic plan view showing a third embodiment of a polishing tool using the polisher according to the present invention.

FIG. 3 is a schematic plan view showing a third embodiment of a polishing tool using the polisher according to the present invention. In FIG. 3, components having the same function as those in FIG. 1 are denoted by the same reference numerals as used in FIG. 1.

This embodiment is different from the first embodiment only in that the polisher comprises a plurality of polisher segments 4'.

Figure 4:
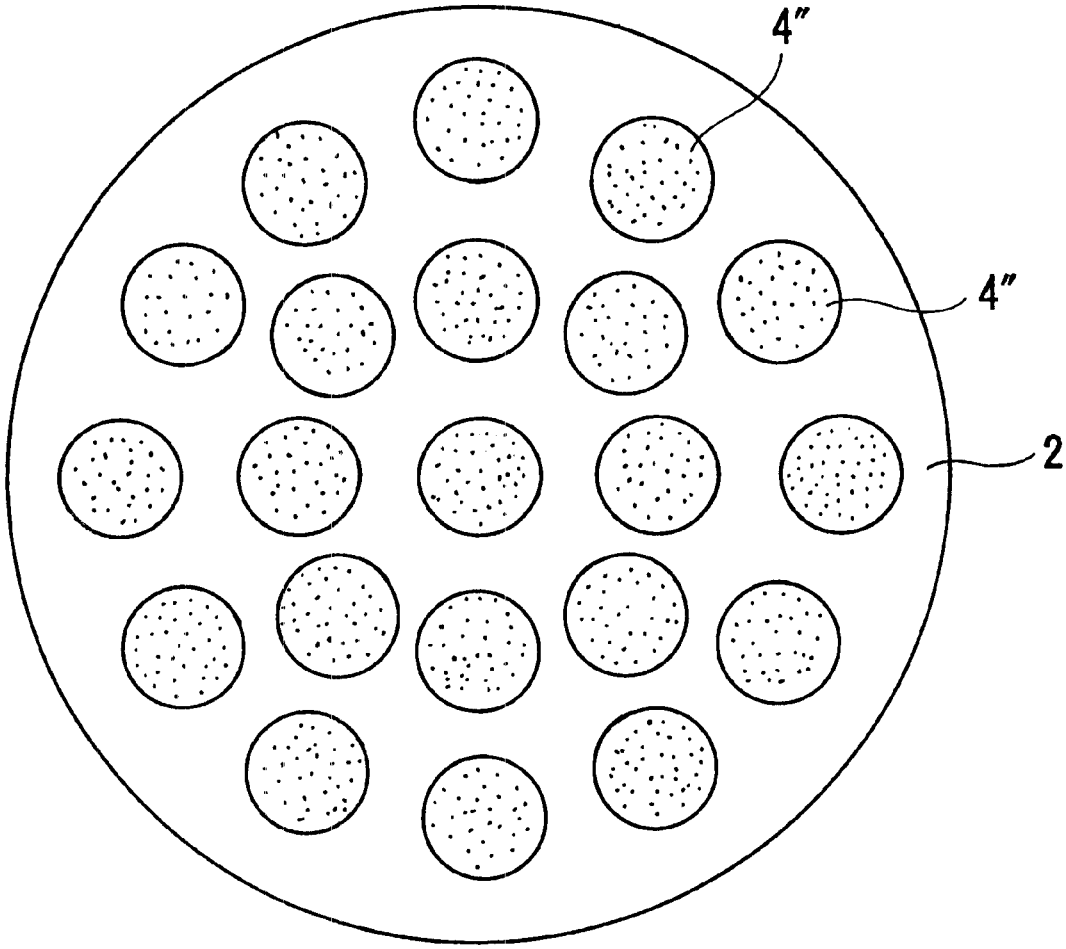
FIG. 4 is a schematic plan view showing a fourth embodiment of a polishing tool using the polisher according to the present invention.

FIG. 4 is a schematic plan view showing a fourth embodiment of a polishing tool using the polisher according to the present invention. In FIG. 4, components having the same function as those in FIG. 1 are denoted by the same reference numerals as used in FIG. 1.

This embodiment is different from the first embodiment only in that the polisher comprises a plurality of polisher pellets 4".

Figure 5:
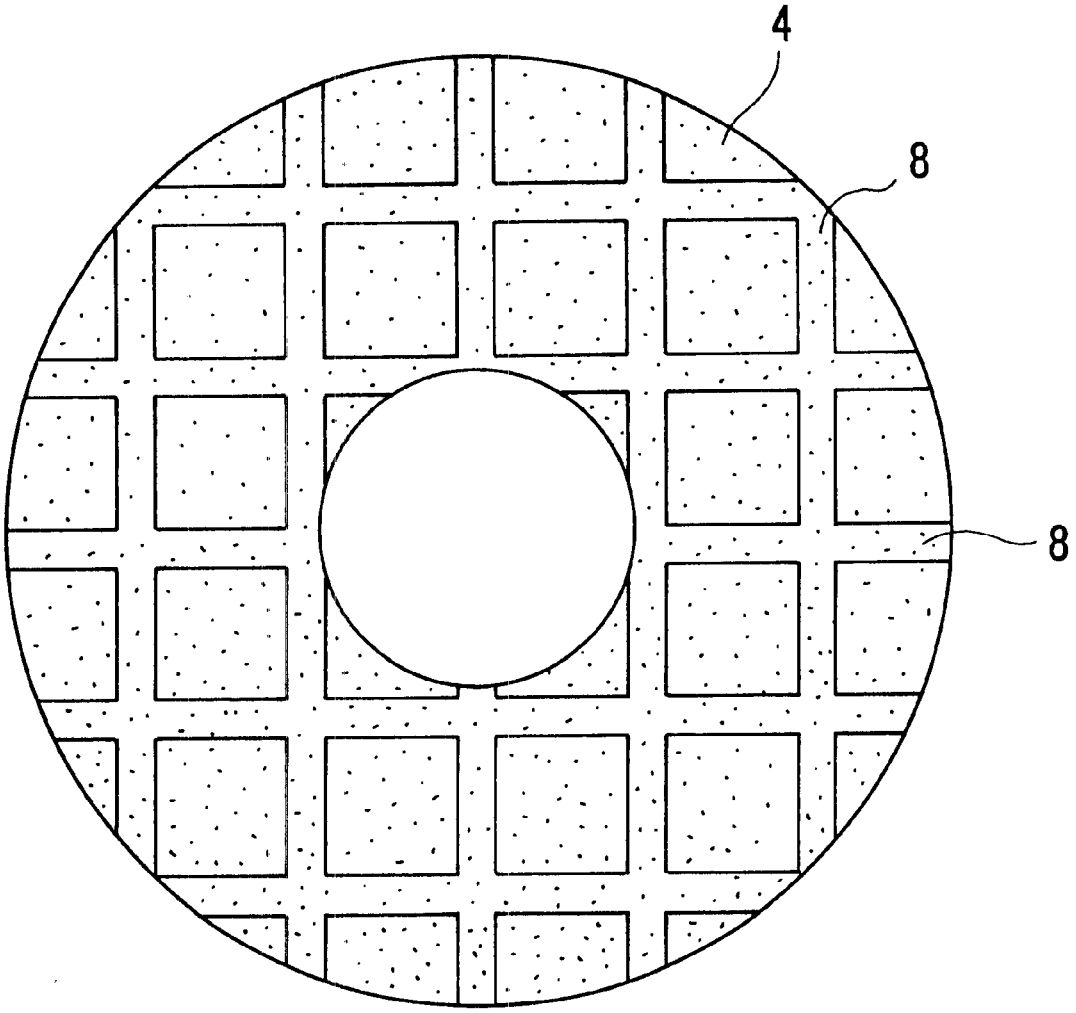
FIG. 5 is a schematic plan view showing a fifth embodiment of a polishing tool using the polisher according to the present invention.

FIG. 5 is a schematic plan view showing a fifth embodiment of a polishing tool using the polisher according to the present invention. In FIG. 5, components having the same function as those in FIG. 1 are denoted by the same reference numerals as used in FIG. 1.

This embodiment is different from the second embodiment only in that the polisher 4 has grooves 8 in its surface. The grooves 8 may be provided in a desired pattern. The depth of the grooves may be, for example, one-fourth to three-fourths of the thickness T of the polisher 4, but is not particularly limited. The grooves 8 may be formed by preparing the polisher according to the second embodiment, and then grinding or cutting the prepared polisher.

Figure 6:
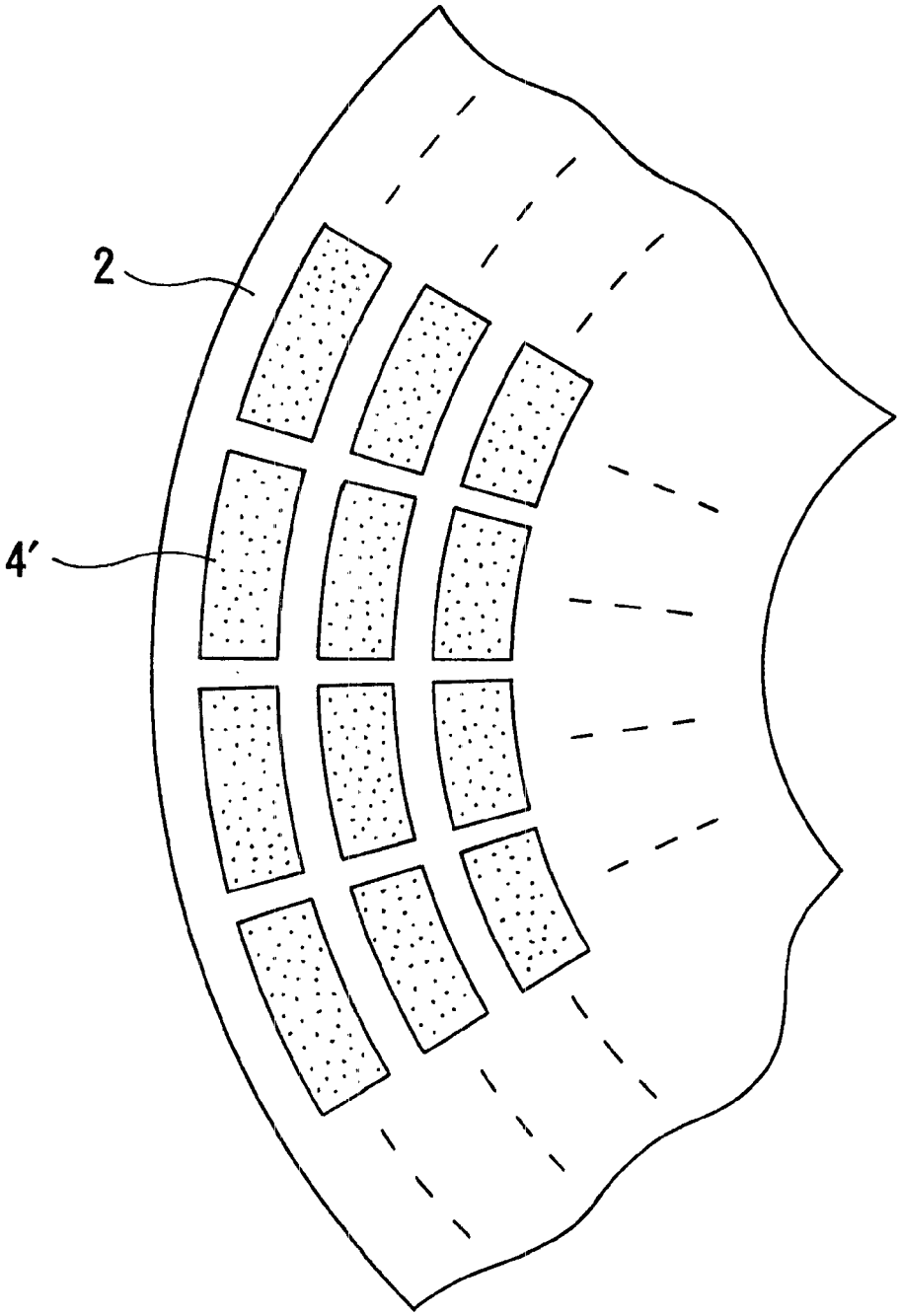
FIG. 6 is a schematic fragmentary plan view showing a sixth embodiment of a polishing tool using the polisher according to the present invention.

FIG. 6 is a schematic fragmentary plan view showing a sixth embodiment of a polishing tool using the polisher according to the present invention. In FIG. 6, components having the same function as those in FIG. 3 are denoted by the same reference numerals as used in FIG. 3.

This embodiment is different from the third embodiment in the shape and the arrangement of polisher segments 4'.

Figure 7:
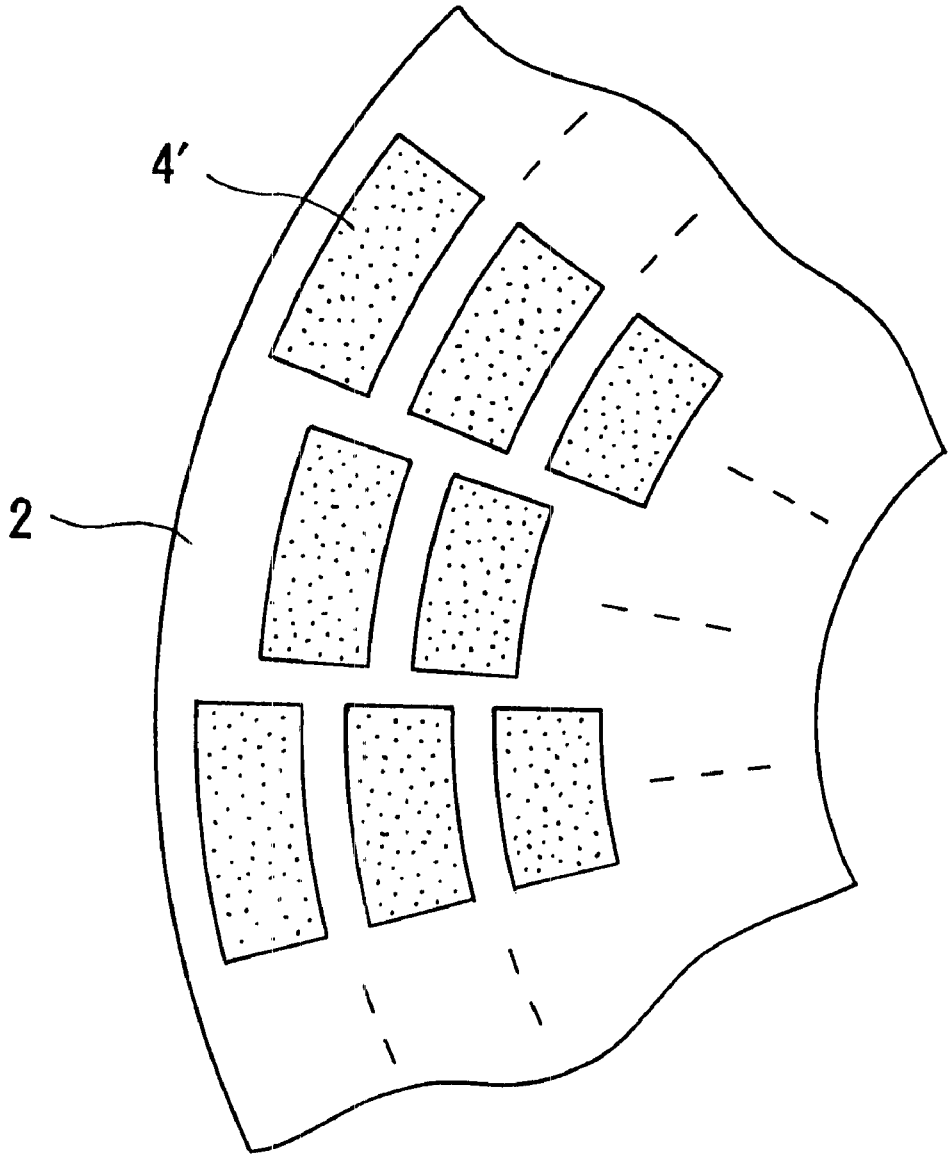
FIG. 7 is a schematic fragmentary plan view showing a seventh embodiment of a polishing tool using the polisher according to the present invention.

FIG. 7 is a schematic fragmentary plan view showing a seventh embodiment of a polishing tool using the polisher according to the present invention. In FIG. 7, components having the same function as those in FIG. 6 are denoted by the same reference numerals as used in FIG. 6.

This embodiment is different from the sixth embodiment in the arrangement of polisher segments 4'.

Figure 8:
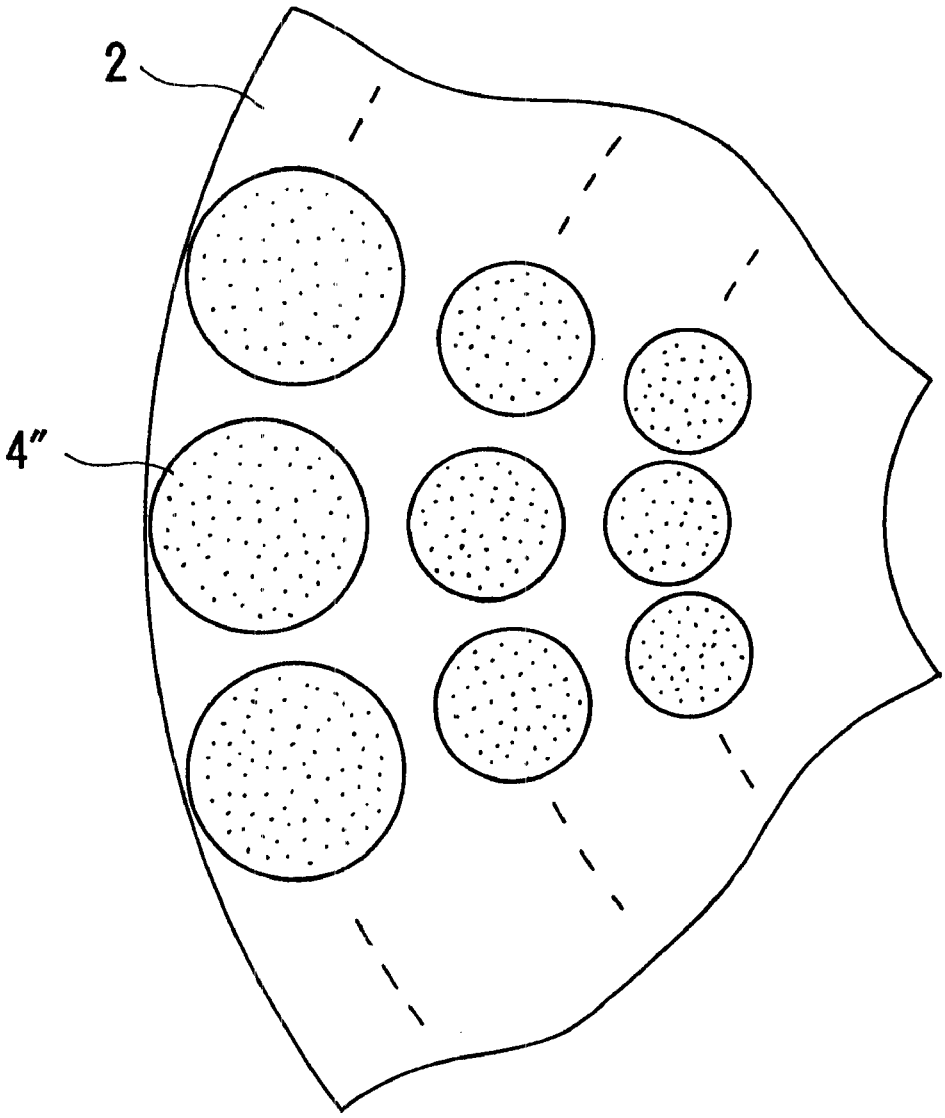
FIG. 8 is a schematic fragmentary plan view showing an eighth embodiment of a polishing tool using the polisher according to the present invention.

FIG. 8 is a schematic fragmentary plan view showing an eighth embodiment of a polishing tool using the polisher according to the present invention. In FIG. 8, the components having the same function as those in FIG. 4 are denoted by the same reference numerals as used in FIG. 4.

This embodiment is different from the fourth embodiment in the dimension and the arrangement of polisher pellets 4". Specifically, according to the fourth embodiment, polisher pellets 4" having the same dimension are disposed in the circumferential direction in each of a plurality of substantially concentrically disposed rings, whereas, in the eighth embodiment, the outer dimensions of the polisher pellets 4" disposed are different from each other for respective rings.

Thus, the use of polisher pellets 4" having smaller outer diameter in more internally disposed rings permits the number of polisher pellets 4" disposed in each of the rings to be identical.

Figure 9:
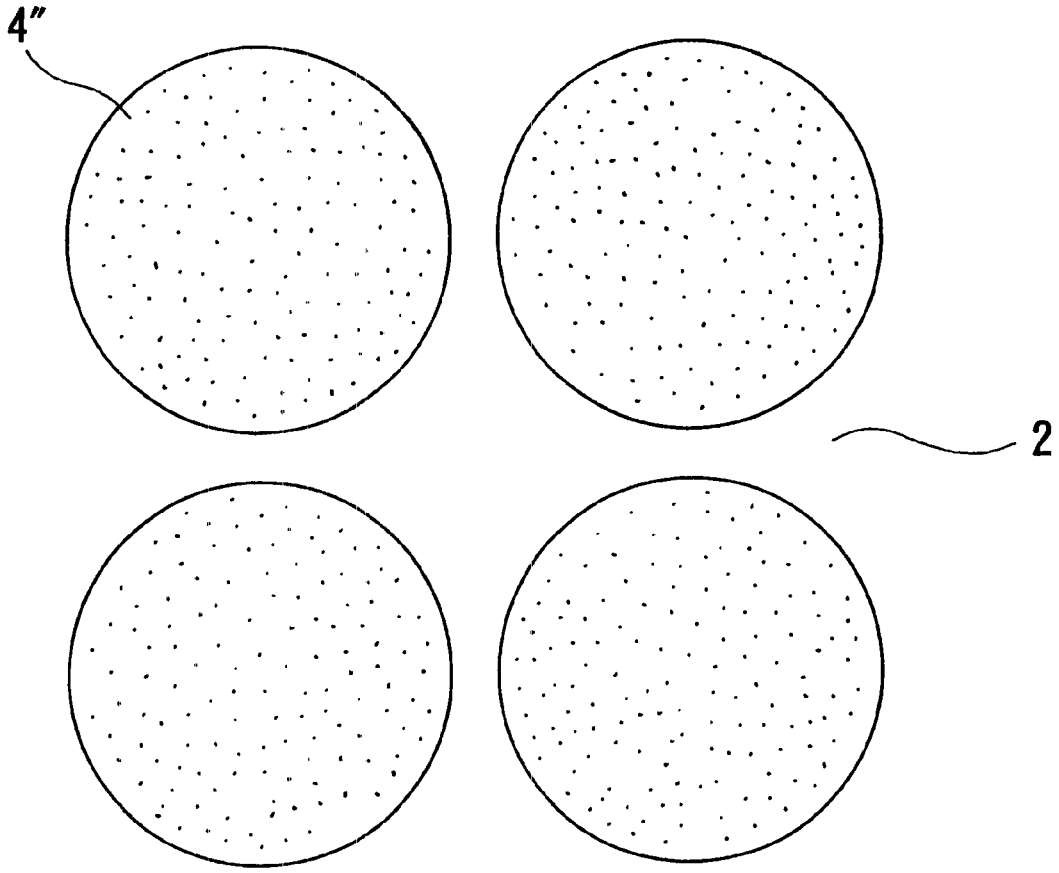
FIG. 9 is a schematic fragmentary plan view showing a ninth embodiment of a polishing tool using the polisher according to the present invention.

FIG. 9 is a schematic fragmentary plan view showing a ninth embodiment of a polishing tool using the polisher according to the present invention. In FIG. 9, components having the same function as those in FIG. 4 are denoted by the same reference numerals as used in FIG. 4.

According to this embodiment, polisher pellets 4" are arranged on respective lattice points of a square.

Figure 10:
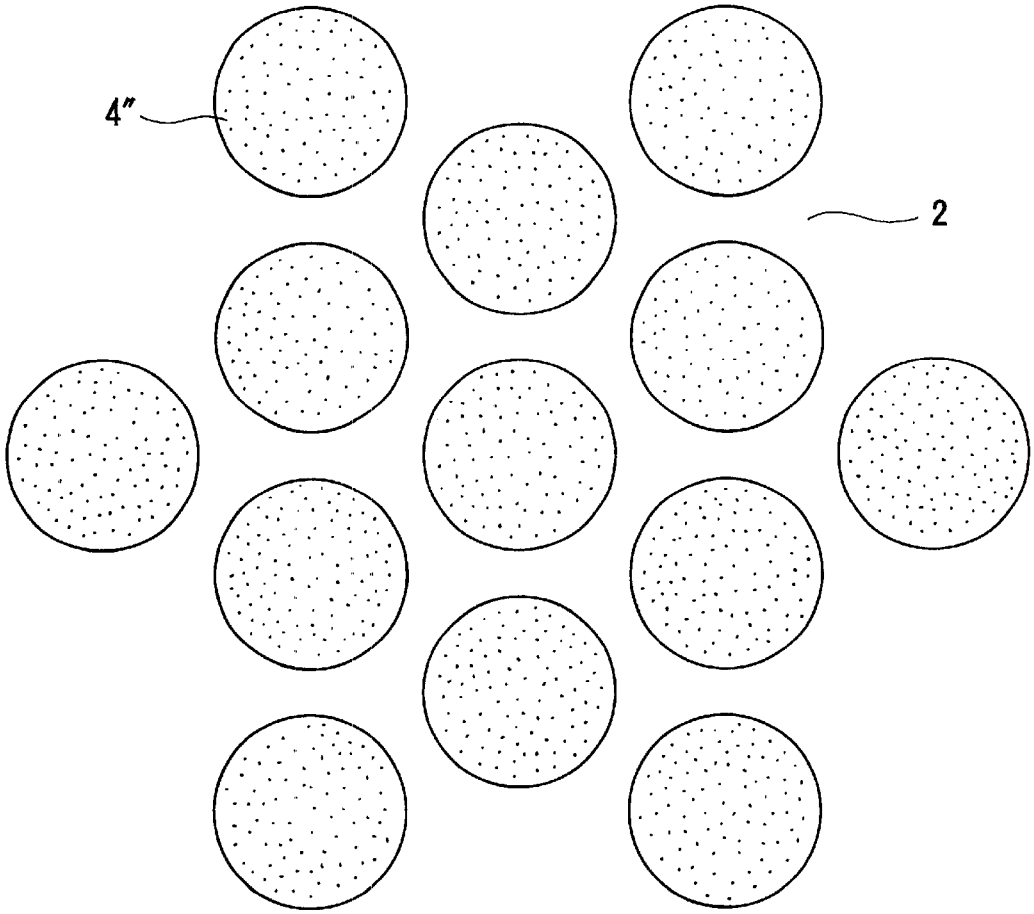
FIG. 10 is a schematic fragmentary plan view showing a tenth embodiment of a polishing tool using the polisher according to the present invention.

FIG. 10 is a schematic fragmentary plan view showing a tenth embodiment of a polishing tool using the polisher according to the present invention. In FIG. 10, components having the same function as those in FIG. 4 are denoted by the same reference numerals as used in FIG. 4.

According to this embodiment, polisher pellets 4" are arranged on respective lattice points of an equilateral triangle to constitute the closest packing arrangement.

The polishing tool according to the first to tenth embodiments described above may be used in a single side polishing machine in which, as described above in connection with FIG. 1, the polishing tool is rotated about the center X of rotation by means of a rotating means (not shown) to polish one side of an object held by an object holder. Alternatively, the polishing tool may be used in a double side polishing machine in such a manner that two of this type of polishing tool are provided in a pair and disposed so that the polishers face each other, an object to be polished, held by a certain holder, is disposed between the pair of polishers, and the pair of polishing tools is rotated about the center X of rotation in directions opposite to each other to simultaneously polish both sides of the object.

Further, the polishing tools according to the present invention may also be used in a swing type polishing machine which has hitherto been used for polishing optical elements. In this case, polishing can be successfully performed in the case where the surface of the object to be polished is flat, as well as in a case where it is curved and, for example, spherical.

The supply of a polishing liquid is preferred in performing polishing by the polishing tool according to the present invention. As a polishing liquid, for example, water, ultrapure water, ion-exchanged water, and alcohols such as ethyl alcohol, isopropyl alcohol, ethylene glycol, and propylene glycol may be used solely or by mixing two or more in a proper ratio.

The present invention will be described with reference to the following examples.

Example 1

100 parts by weight of cerium oxide particles (purity 75%) having an average particle diameter of 1 $\mu$m was mixed with 20 parts by weight of polyimide resin particles having an average particle diameter of 10 $\mu$m in a dry mixer for one hour. The mixture was then charged into a mold. A pressure of 29,400 kPa (300 kg/cm$^2$) was applied while the mold was heated to a mold surface temperature of 230° C., and the mold was maintained in this state for one hour. Thereafter, the mold was cooled, and the molded polisher was taken out of the mold.

The polisher thus obtained had Dϕ=250 mmϕ, T=10 mm, abrasive grains of 30% by volume, a binder of 45% by volume, pores of 25% by volume, specific gravity of about 2.7, and grade (Rockwell hardness) of about 50.

This polisher was attached to one side of a stainless steel surface plate having the same diameter as the polisher by an epoxy adhesive to produce a polishing tool.

When a silicon oxide insulating layer provided on the surface of a silicon wafer was polished by this polishing tool, the flatness achieved by this polishing was about 2.3 times better than that achieved by polishing of an equivalent object by conventional polishing with free abrasive grains, using a combination of a polishing tool of a polisher formed of a polyurethane pad with free abrasive grains of cerium oxide. That is, in the conventional method, the flatness error was about 0.5 $\mu$m, whereas, according to this example of the present invention, the flatness error was about 0.2 $\mu$m.

Example 2

100 parts by weight of cerium oxide particles (purity 75%) having an average particle diameter of 1 $\mu$m was mixed with 30 parts by weight of phenolic resin particles having an average particle diameter of 12 $\mu$ in a dry mixer for one hour. The mixture was then charged into a mold. A pressure of 49,000 kPa (500 kg/cm$^2$) was applied while the mold was heated to a mold surface temperature of 160° C., and the mold was maintained in this state for one hour. Thereafter, the mold was cooled, and the molded polisher was taken out of the mold.

The polisher thus obtained had Dϕ=250 mmϕ, T=10 mm, abrasive grains of 40% by volume, a binder of 45% by volume, pores of 15% by volume, specific gravity of about 3.0, and grade (Rockwell hardness) of about 100.

This polisher was attached to one side of a stainless steel surface plate having the same diameter as the polisher by an epoxy adhesive to produce a polishing tool.

When a silicon oxide insulating layer provided on the surface of a silicon wafer was polished by this polishing tool, the flatness achieved by this polishing was about 3.4 times better than that achieved by polishing of an equivalent object by conventional polishing with free abrasive grains, using a combination of a polishing tool of a polisher formed of a polyurethane pad with free abrasive grains of cerium oxide. That is, in the conventional method, the flatness error was about 0.5 $\mu$m, whereas, according to this example of the present invention, the flatness error was about 0.15 $\mu$m.

As described above, according to the present invention, by heating a mixture of abrasive grains and thermosetting resin particles under pressure to mold the mixture into a desired shape, there is provided a polisher comprising abrasive grains dispersed in a thermosetting resin and having abrasive grains of 20 to 60% by volume, a binder of 30 to 50% by volume, and pores of not more than 40% by volume. This polisher and a polishing tool using the polisher neither poses a problem of treatment of an abrasive-containing polishing liquid involved in polishing with free abrasive grains, nor poses a problem of contamination of the object to be polished, caused by the arrival of dust of the abrasive grains and mist containing the abrasive grains at the object. Conventional polishers with fixed abrasive grains using a synthetic resin binder have not been molded under a pressure of 9,800 to 49,000 kPa (100 to 500 kg/cm$^2$), and thus have a low hardness, making it difficult to provide good accuracy. In contrast, the polishing tool according to the present invention has sufficiently high hardness, and hence, can realize a high surface accuracy of the object.

Thus, the polishing tool according to the present invention, by virtue of its high hardness, has improved durability and slow wastage. Therefore, the surface accuracy of the polisher is not rapidly lowered, and hence, it is possible to maintain the surface accuracy of the polisher for a long period of time, and the polisher is suitable for constructing an automatic polishing system that automatically performs a polishing operation for a long period of time.

What is claimed is:

1. A polisher comprising:

a binder including a thermosetting resin comprising one of a polyimide resin and a phenolic resin; and a plurality of abrasive grains having an average particle diameter of 0.01 to 2.0 $\mu$m, said plurality of abrasive grains comprising at least one of cerium oxide, manganese oxide, titanium oxide, zirconia, silica, and iron oxide, and said plurality of abrasive grains being dispersed in said thermosetting resin, wherein said polisher has said plurality of abrasive grains being 20 to 60% by volume, said binder being 30 to 50% by volume, and pores being not more than 40% by volume.

2. A polisher according to claim 1, wherein said polisher has a Rockwell hardness of not less than 30 in terms of H scale.

3. A process for producing a polisher, said process comprising:

heating a mixture of a plurality of abrasive grains and a binder including a plurality of thermosetting resin particles under pressure to mold the mixture into a shape, wherein the pressure is in a range of 9,800 to 49,000 kPa, and the shape has the plurality of abrasive grains being 20 to 60% by volume, the binder being 30% to 50% by volume, and pores being not more than 40% by volume.

4. A polishing tool comprising:

a polisher comprising a binder including a thermosetting resin comprising one of a polyimide resin and a phenolic resin, and a plurality of abrasive grains having an average particle diameter of 0.01 to 2.0 $\mu$m, said plurality of abrasive grains comprising at least one of cerium oxide, manganese oxide, titanium oxide, zirconia, silica, and iron oxide, and said plurality of abrasive grains being dispersed in said thermosetting resin, wherein said polisher has said plurality of abrasive grains being 20 to 60% by volume, said binder being 30% to 50% by volume, and pores being not more than 40% by volume; and a polisher holding member on which said polisher is mounted.

5. A polishing tool according to claim 4, further comprising an adhesive, wherein said polisher is mounted on said polisher holding member by said adhesive.

6. A polishing tool according to claim 4, wherein a surface of said polisher has grooves.

7. A polishing tool according to claim 4, wherein said polisher comprises a plurality of polishing segments, said plurality of polishing segments being mounted on said polisher holding member.

8. A polishing tool according claim 4, wherein said polisher comprises a plurality of polishing pellets, said plurality of polishing pellets being mounted on said polisher holding member.

9. A polishing tool according to claim 4, wherein said polisher and said polisher holding member are circular and have a circular opening at their respective centers.

10. A polishing tool according to claim 6, wherein sections of said surface of said polisher formed between the grooves are square shaped.

11. A polishing tool according to claim 7, wherein said plurality of polishing segments are shaped as sectors of a circle such that spaces between adjacent pairs of said plurality of polishing segments extend radially and continuously from a center of said surface to an outer edge of said surface.

12. A polishing tool according to claim 7, wherein said plurality of polishing segments are arc-shaped quadrilaterals having a pair of parallel sides positioned such that spaces between adjacent pairs of said plurality of polishing segments extend radially and continuously from a center of said surface to an outer edge of said surface and also form concentric and continuous circles around the center of said surface.

13. A polishing tool according to claim 7, wherein said plurality of polishing segments are arc-shaped quadrilaterals having a pair of parallel sides positioned such that spaces between adjacent pairs of said plurality of polishing segments extend radially and continuously from a center of said surface to an outer edge of said surface and also form arcuate segments located between adjacent pairs of said plurality of polishing segments.

14. A polishing tool according to claim 8, wherein said plurality of polishing pellets are circular and all have a same diameter.

15. A polishing tool according claim 8, wherein said plurality of polishing pellets are circular and form a number of concentric circles around a center of said surface, such that diameters of polishing pellets making up each of the number of concentric circles increases the further away each of the concentric circles is from the center of said surface.

16. A polishing tool according to claim 14, wherein said plurality of polishing pellets are arranged on respective lattice points of a square.

17. A polishing tool according to claim 14, wherein said plurality of polishing pellets are arranged on respective lattice points of an equilateral triangle.

* * * * *